US008322877B1

(12) United States Patent
Merritt

(10) Patent No.: US 8,322,877 B1
(45) Date of Patent: Dec. 4, 2012

(54) REMOTELY POSITIONABLE LIGHT

(76) Inventor: Brian Lee Merritt, Richardson, TX (US)

( * ) Notice: Subject to any disclaimer, the term of this patent is extended or adjusted under 35 U.S.C. 154(b) by 470 days.

(21) Appl. No.: 12/462,181

(22) Filed: Jul. 30, 2009

Related U.S. Application Data

(60) Provisional application No. 61/137,696, filed on Aug. 1, 2008.

(51) Int. Cl.
*F21V 19/02* (2006.01)
*F21V 21/00* (2006.01)

(52) U.S. Cl. ..... 362/220; 362/249.07; 362/430; 362/286; 362/384

(58) Field of Classification Search ..... 362/384, 362/217.14–217.17, 220, 249.03, 249.04, 362/249.07–249.11, 285, 286, 239, 371, 362/372, 418–428, 430, 431
See application file for complete search history.

(56) References Cited

U.S. PATENT DOCUMENTS

| | | | | | |
|---|---|---|---|---|---|
| 3,535,509 | A * | 10/1970 | Thornton | 362/220 |
| 4,042,255 | A * | 8/1977 | Drewek et al. | 280/445 |
| 4,600,980 | A * | 7/1986 | Dahlgren | 362/385 |
| 4,803,606 | A * | 2/1989 | Rotter | 362/249.09 |
| 5,126,928 | A * | 6/1992 | Hughes | 362/287 |
| 5,424,931 | A * | 6/1995 | Wheeler | 362/418 |
| 5,572,837 | A * | 11/1996 | Featherstone et al. | 52/118 |
| 5,743,635 | A * | 4/1998 | Hulse et al. | 362/385 |
| 6,019,484 | A * | 2/2000 | Seyler | 362/287 |
| 6,484,456 | B1 * | 11/2002 | Featherstone et al. | 52/118 |
| 6,854,862 | B1 * | 2/2005 | Hopf | 362/220 |
| 7,193,508 | B2 * | 3/2007 | Hill et al. | 340/431 |
| 7,989,979 | B2 * | 8/2011 | Burgess et al. | 307/10.1 |

* cited by examiner

*Primary Examiner* — Bao Q Truong
(74) *Attorney, Agent, or Firm* — Jeffrey Roody

(57) ABSTRACT

A work light assembly remotely positionable by means of a radio frequency transmitter signaling a motion controller driving a linear actuator. The light source is mounted on a pivoting boom that is in turn mounted to an upright post that telescopes up or down by means of manual controls interfaced with the controller, or by way of an RF transmitter commanding the controller. Motive properties such as maximum telescoping travel speed are preset at the controller.

12 Claims, 12 Drawing Sheets

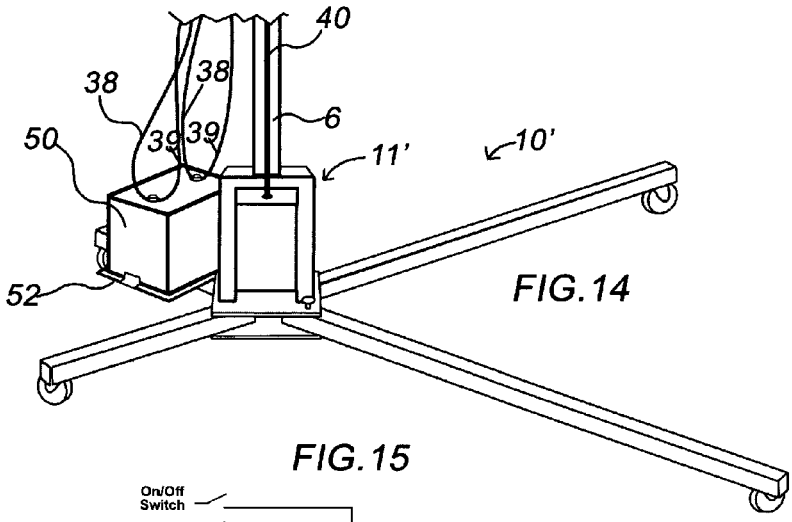
FIG. 14
FIG. 15
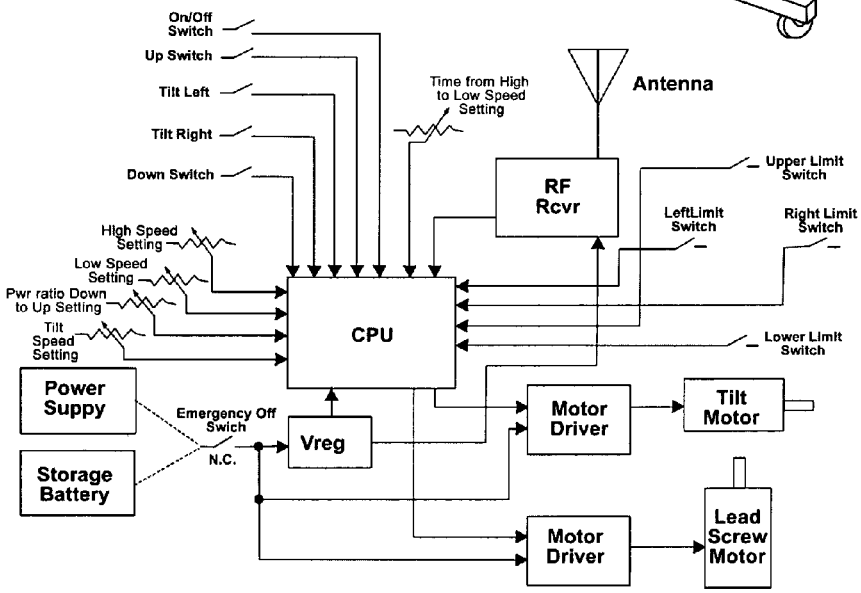

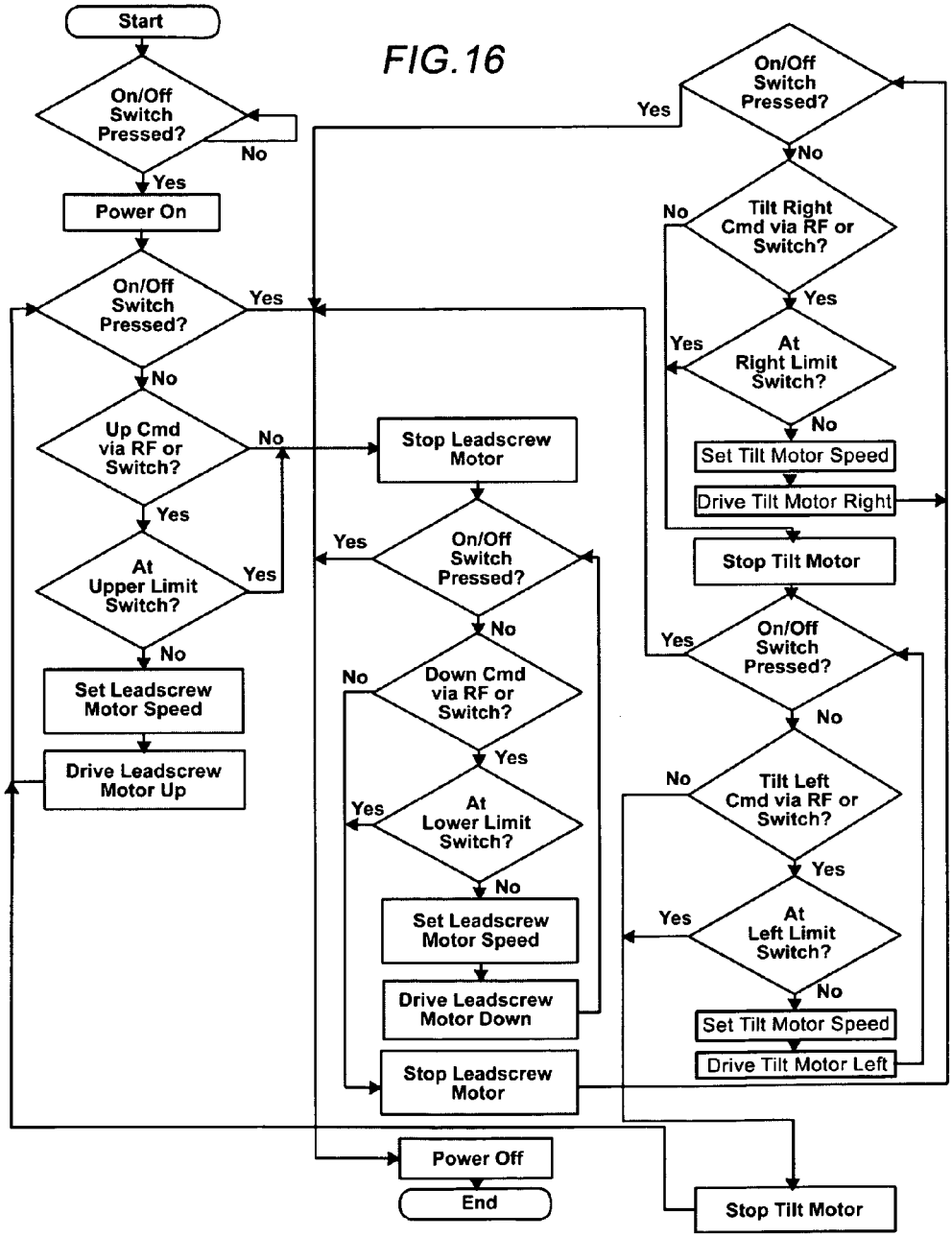
FIG. 16
Start
On/Off Switch Pressed?
No
Yes
Power On
On/Off Switch Pressed?
Yes
No
Up Cmd via RF or Switch?
No
Yes
At Upper Limit Switch?
Yes
No
Set Leadscrew Motor Speed
Drive Leadscrew Motor Up
Stop Leadscrew Motor
On/Off Switch Pressed?
Yes
No
Down Cmd via RF or Switch?
No
Yes
At Lower Limit Switch?
Yes
No
Set Leadscrew Motor Speed
Drive Leadscrew Motor Down
Stop Leadscrew Motor
Power Off
End
On/Off Switch Pressed?
Yes
No
Tilt Right Cmd via RF or Switch?
No
Yes
At Right Limit Switch?
Yes
No
Set Tilt Motor Speed
Drive Tilt Motor Right
Stop Tilt Motor
On/Off Switch Pressed?
Yes
No
Tilt Left Cmd via RF or Switch?
No
Yes
At Left Limit Switch?
Yes
No
Set Tilt Motor Speed
Drive Tilt Motor Left
Stop Tilt Motor

REMOTELY POSITIONABLE LIGHT

CROSS REFERENCE TO RELATED APPLICATIONS

This application claims the benefit of Provisional Patent Application No. 61/137,696 filed Aug. 1, 2008

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

The present invention is directed to a light that is remotely positionable by a radio frequency transmitter signaling a motion controller driving a linear actuator. Motive properties are preset at the controller. In the fields of vehicle dent repair, photography, videography and others, it is common practice to use specialized work lights to produce various lighting effects where the light source is often several feet away from the actual work area. This arrangement makes it necessary for the technician or an assistant to leave the immediate work area and manually adjust the light source resulting in much trial and error experimentation before achieving the desiied lighting effect. Repeated adjusting of the light source leads to loss of time and reduced productivity.

Work lights designed for auto-body repair have long been known in the art. Current solutions ranging from stand mounted, fixed position or hanging work lights all suffer from the same disadvantage; the inability of the repair technician to maintain a line of sight relative to the work surface while adjusting the light source. What is needed is a means of remotely adjusting a work light incrementally to assist in achieving a desired lighting effect without the technician having to leave the immediate work area.

SUMMARY OF THE INVENTION

The present invention involves a light housing mounted on a pivoting and rotating boom with handle, which in turn is connected to a vertically telescoping member by a tensionable pivot clamp; the telescoping member being raised and lowered by a linear actuator driven by a controller remotely activated by a radio frequency transmitter. In one embodiment, the light housing is joined to the boom with a pivoting and rotating coupler and may be manually fixed in position. In another embodiment, the light housing can be commanded via the radio frequency transmitter to also tilt in either direction relative to its axis, at the point where the light housing is mounted to the pivoting and rotating boom, in order to provide optimal lighting of the work area. While the common elements to all described embodiments are a rolling base, a housing for a linear actuator joined to an upright conduit, a controller joined to the upright conduit, a telescoping member inside the upright conduit movable in a vertical up or down direction by means of the linear actuator, a pivoting and rotating boom clamped to the telescoping member with a light housing at one end; it is to be understood that a tilting means utilizing a bi-directional motor for the light housing and a battery power source can be used with any combination of the aforementioned elements, or conceivably, the tilting means described could be used with lights that are otherwise manually positionable. The linear actuator housing is removably secured atop the rolling base. A controller with a control box surround and a control panel is mounted to the conduit surrounding the driven telescoping member, of which the specific motive behavior e.g. maximum speed, is pre-set at the controller. While the preferred embodiment features one fast speed selector dial for setting of a telescoping speed limit to quickly ramp to the selected speed limit and then continually maintain the selected speed, in another embodiment, the controller is capable of inputting other motion parameters such as a baseline setting for the telescoping movement followed by a faster rate of travel for gross adjustments. The movement is reset to the baseline setting after the RF control switches or control panel switches are released and the system stops, or if the RF or panel switches for the other direction of travel are pressed. In any of the aforementioned embodiments, the controller is capable of processing the motion commands related to the bi-directional motor for the tilting movement of the light housing. While the present invention is potentially useful in trades involving lighting such as photography and videography, it is especially well suited to the trade of paintless dent repair (PDR), a common technique used by car dealers and auctioneers to prepare vehicles for sale. PDR is used extensively in cases where a vehicle has sustained hail damage where the dents are best viewed and repaired when viewed from a particular angle with the correct lighting. By positioning the light over a work area and telescopically adjusting the height, and optionally the tilt of the light housing, by means of the RF transmitter, the reflection of the light moves back and forth across the work area. This enables the technician to move from one dent to the next and subtle disruptions of a work surface may be easily located obviating the need to manually move and adjust the light to alter the angle of incidence of the light upon a given work surface.

Disassembly of the light assembly for transport is easily accomplished and involves removal of the light housing and boom extension from the pivoting and rotating boom with handle residing atop the vertical telescoping member, and removal of the upright conduit and linear actuator housing from the rolling base. The rolling base has two rigid studs insert-able into mating portions formed of channel members to each side of the linear actuator housing, being held tightly therein by retractable threaded knobs for clamping the studs against the inner wall of the channel members.

One object of the present invention is to provide a means of remotely adjusting a light source obviating the need for a technician to manually adjust the light source.

Another object of the present invention is to provide a means for a user to maintain a specific line of sight directed to a work area while allowing for the remote adjustment of a light source.

Yet another object of the present invention is to reduce the travel time and related trial and error in achieving a desired lighting effect upon a work area.

A further object of the present invention is to relieve a user of the discomfort and fatigue associated with distorting their body in order to maintain a desired angle of incidence of a light source upon a work surface as they move from dent to dent.

The description as follows is not intended to limit the scope of the invention to the particular forms set forth, but on the contrary, it is intended to cover such alternatives, modifications, combinations and equivalents as may be included within the spirit and scope of the invention as set forth in the detailed description.

BRIEF DESCRIPTION OF THE DRAWINGS

FIG. 2 is a detail view of the light stand guide fitting;

FIG. 14 shows one embodiment according to the present invention with a battery mounted on the rear leg or legs;

FIG. 15 is a block level diagram of the basic components of the controller according to the embodiment shown in FIGS. 10-13;

FIG. 16 is a typical operational flow diagram of the controller logic according to the embodiment shown in FIGS. 10-13;

DETAILED DESCRIPTION OF THE INVENTION

Reference Listing

Figure 1:
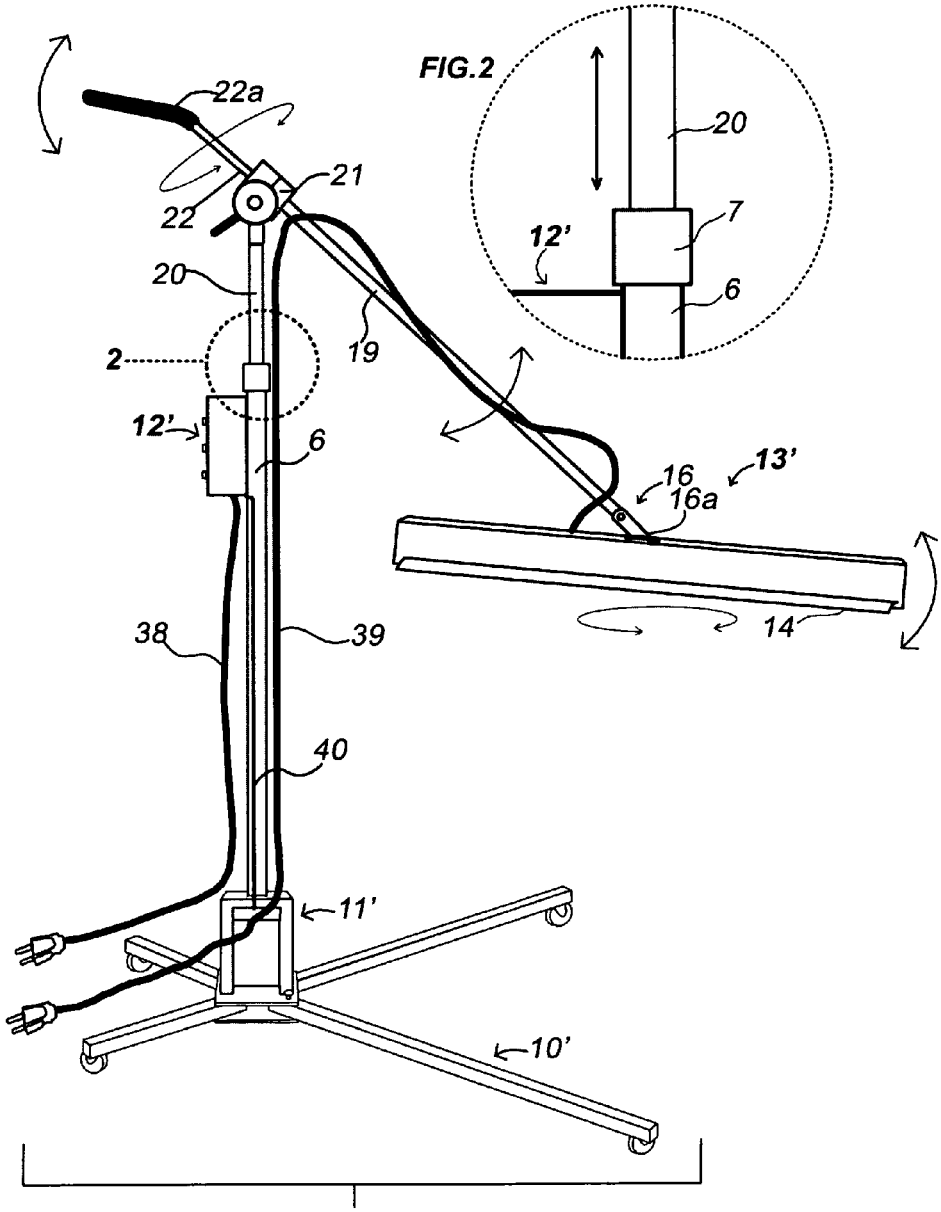
FIG. 1 is a perspective view of the preferred embodiment according to the present invention of the work light assembly.

6 upright conduit
7 guide fitting
8*a* mounting studs
8*b* channel aperture
9 mounting plates
10' base subassembly
11' linear actuator housing
12' controller
13' lighting subassembly
14 light housing
16 light housing coupler
16*a* rotatable coupling
16*c* light housing upper bracket
16*d* light housing lower bracket
18 linear actuator motor
18*a* linear actuator lead screw
19 boom extension
20 telescoping member
20*a* clamp plates
21 clamp pivot
21*a* quick release pin
21*b* pivot clamp tensioner
21*c* compression plates
22 pivot boom
22*a* pivot boom handle
23 power ON/OFF indicator
24 fast speed setting
26 slow speed setting
28 slow to fast time setting
30 down/up power ratio setting
32 manual up control
34 manual on/off control
36 manual down control
38 power cord to controller
39 power cord to light source
40 controller to actuator cable
42 channel member
44 mount for linear actuator
46 bi-directional motor
48 cable from controller to bi-directional motor
50 battery
52 battery box
54 power source toggle
56 emergency OFF
58 tilt left control
60 tilt right control
62 tilt speed control Referring generally to FIGS. 1-6; a preferred embodiment according to the present invention is described as a remotely positionable work light assembly, with automated vertical telescoping motion and a pivoting and rotating boom for angular adjustment of the light source. FIG. 1 shows the preferred embodiment fully assembled; the entire assembly roll-able upon a base subassembly 10' having collapsible legs with casters. Although the drawings represent a four legged rolling base, three legs in a 'Y' configuration are also suitable. Shown also are a lighting subassembly 13' which includes a light housing 14 with light, a light housing coupler 16, with rotatable coupling 16*a*, and a boom extension 19. A pivoting and rotating boom 22 with handle 22*a* extends through a tensionable clamp pivot 21, and is inserted into the hollow body of the tubular boom extension 19 being affixed therein by a quick release pin or pins 21*a*. The entire lighting subassembly may be pivoted up and down as well as angularly, by manually moving the pivoting and rotating boom with handle 22*a* and the light housing coupler 16. Preferably, the light source is fluorescent, although conceivably other lighting types may be used. The power cords 38 and 39, extend from the controller subassembly 12' which includes a controller, controller circuit and a surround, and the lighting subassembly 13' respectively, and are adapted for normal 110/120VAC, although with minor changes they can be connected to a storage battery as shown in FIG. 14. Vertical motion of the telescoping member 20 within the upright conduit 6 is controlled by the controller controlling a linear actuator motor 18 residing in the linear actuator housing 11' typically atop the base subassembly 10'. Total vertical extension of the telescoping member 20 is dependent on the length of a lead screw 18*a* connected to the linear actuator motor 18 at one end, and in contact with the bottom end of the telescoping member. A limit switch (not shown), is positioned on the upright conduit 6 and at the lower end of the lead screw 18*a* to prevent over extension in either the up or down direction. FIG. 2 shows a guide fitting 7 atop the upright conduit with a centered aperture for the passing through of the telescoping member, the purpose of which is to maintain sufficient space between the telescoping member and the interior wall of the upright conduit and allow unimpeded vertical movement of the telescoping member.

Figure 3:
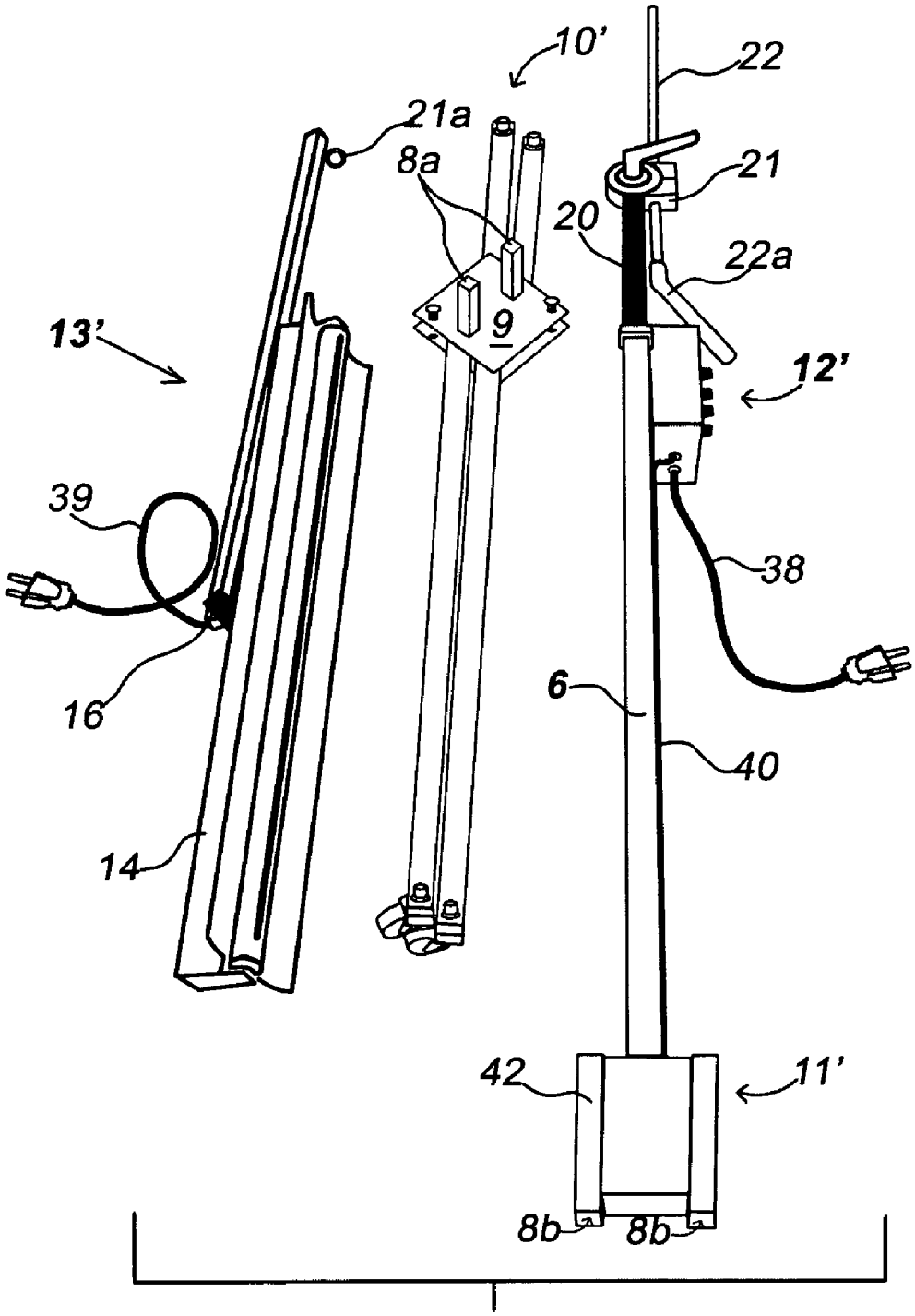
FIG. 3 shows the three basic subassemblies of the preferred embodiment according to the present invention.

Referring to FIG. 3, the entire work light assembly disassembles into three basic subassemblies for ease of transport. A base subassembly 10' shown with four collapsible legs sandwiched between two mounting plates 9, may be extended into an 'X' configuration. The topmost mounting plate has two mounting studs 8*a* for sliding insertion into two members of square channel 42 on either side of the linear actuator housing 11'. The studs 8*a* are held in place by two manually tensionable threaded knobs (not shown) to compress the studs against the interior walls of the square channel members. The linear actuator motor 18 resides between the two square channel members. A controller to actuator cable 40 extends from the controller to the actuator which is preferably an electromechanical jack screw that extends and retracts the telescoping member 20 within the upright conduit 6. Preferably, both the upright conduit 6 and telescoping member 20 are made of steel with a square channel profile for rigidity, although in other non-limiting examples, combinations of tubular steel, aluminum extrusions, or fiberglass/carbon fiber tubing and channel can be employed in similar telescoping arrangements.

Figure 4:
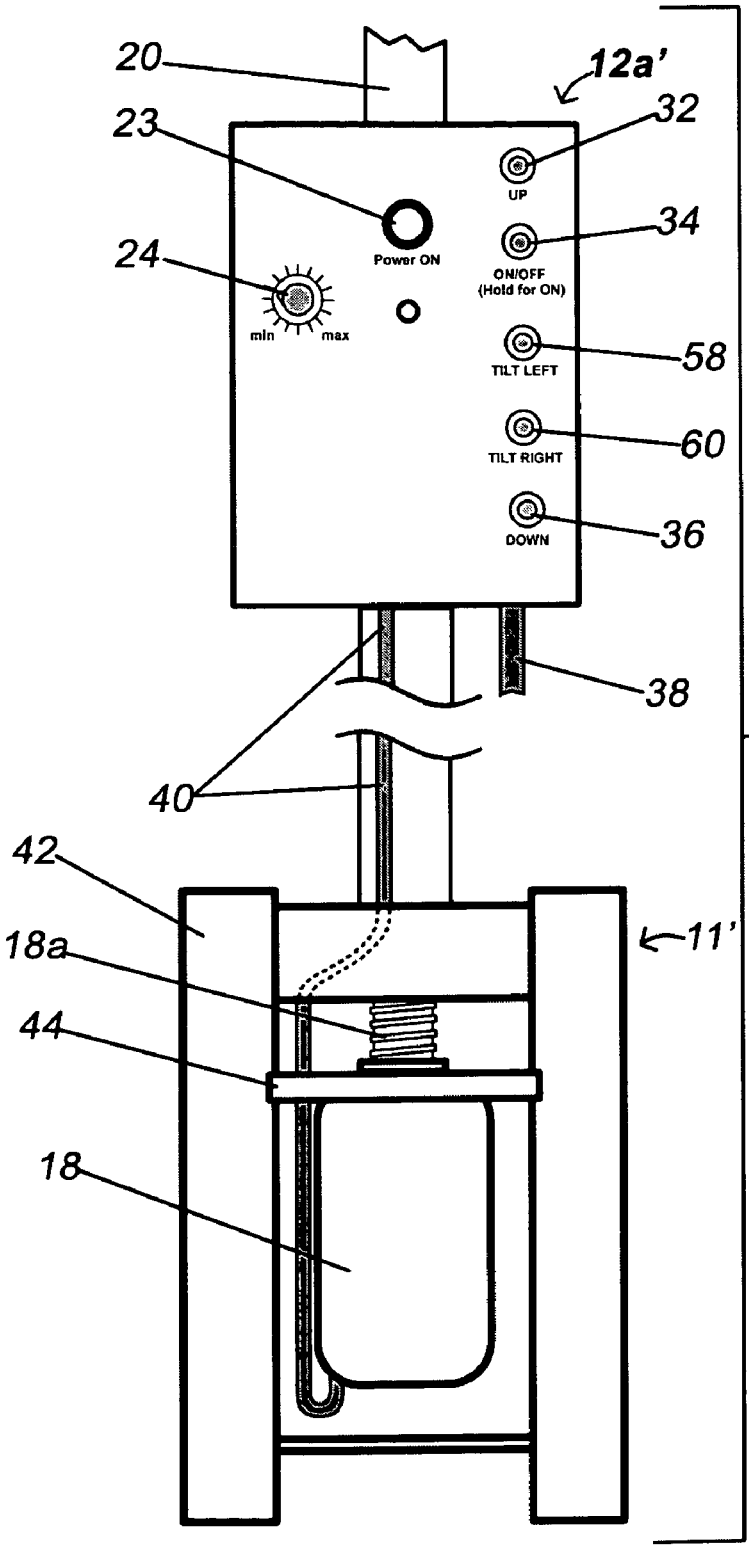
FIG. 4 is a partial plan view of the preferred embodiment of the controller subassembly and the bottom of the light stand subassembly with linear actuator according to the present invention.

Referring to FIG. 4, mounted on the light stand subassembly is the controller subassembly that can receive both manual instructions by pressing the UP/DOWN pushbuttons 32 and 36 respectively, or independent RF instructions sent directly to the antenna of the controller to move the telescoping member. For safety reasons the controller is powered only after pressing the ON/OFF switch for a predetermined length of time. Motive operation is controlled by the CPU of the controller which is in turn limited by at least one speed selection dial 24 which sets an upper speed limit for the telescoping member. A simple key fob RF transmitter with three fixed frequencies, of the general type available from various electronics suppliers such as Abacom Technologies, Inc. of Toronto, Canada, is the remote control for the controller.

Figure 5:
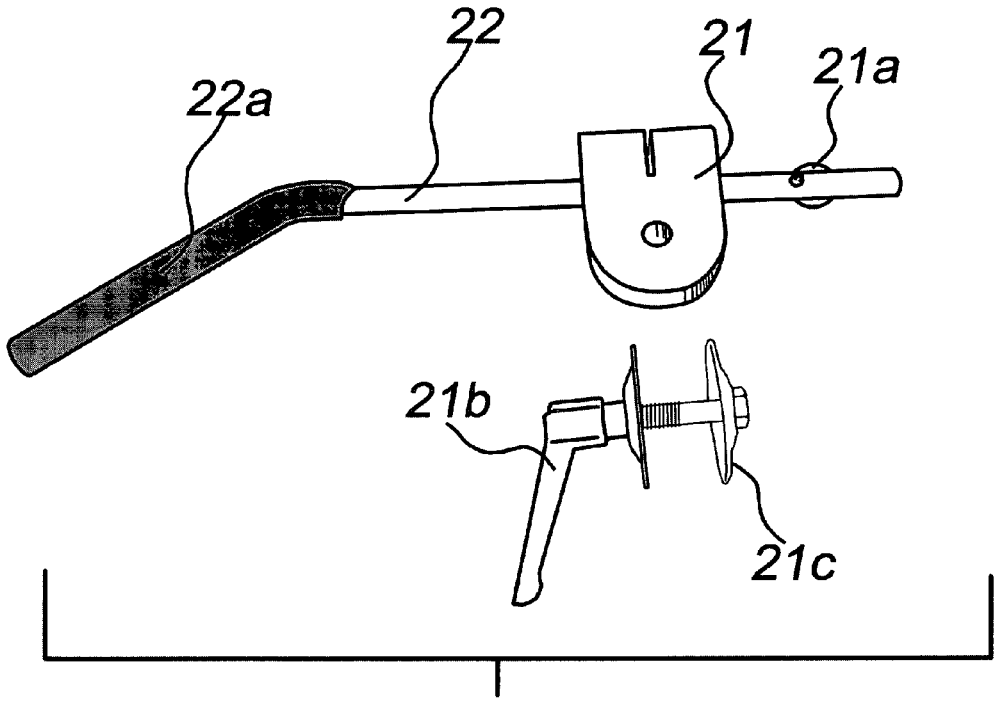
FIG. 5 shows the pivot clamp and pivoting and rotating boom with handle and clamp tensioner.
Figure 6:
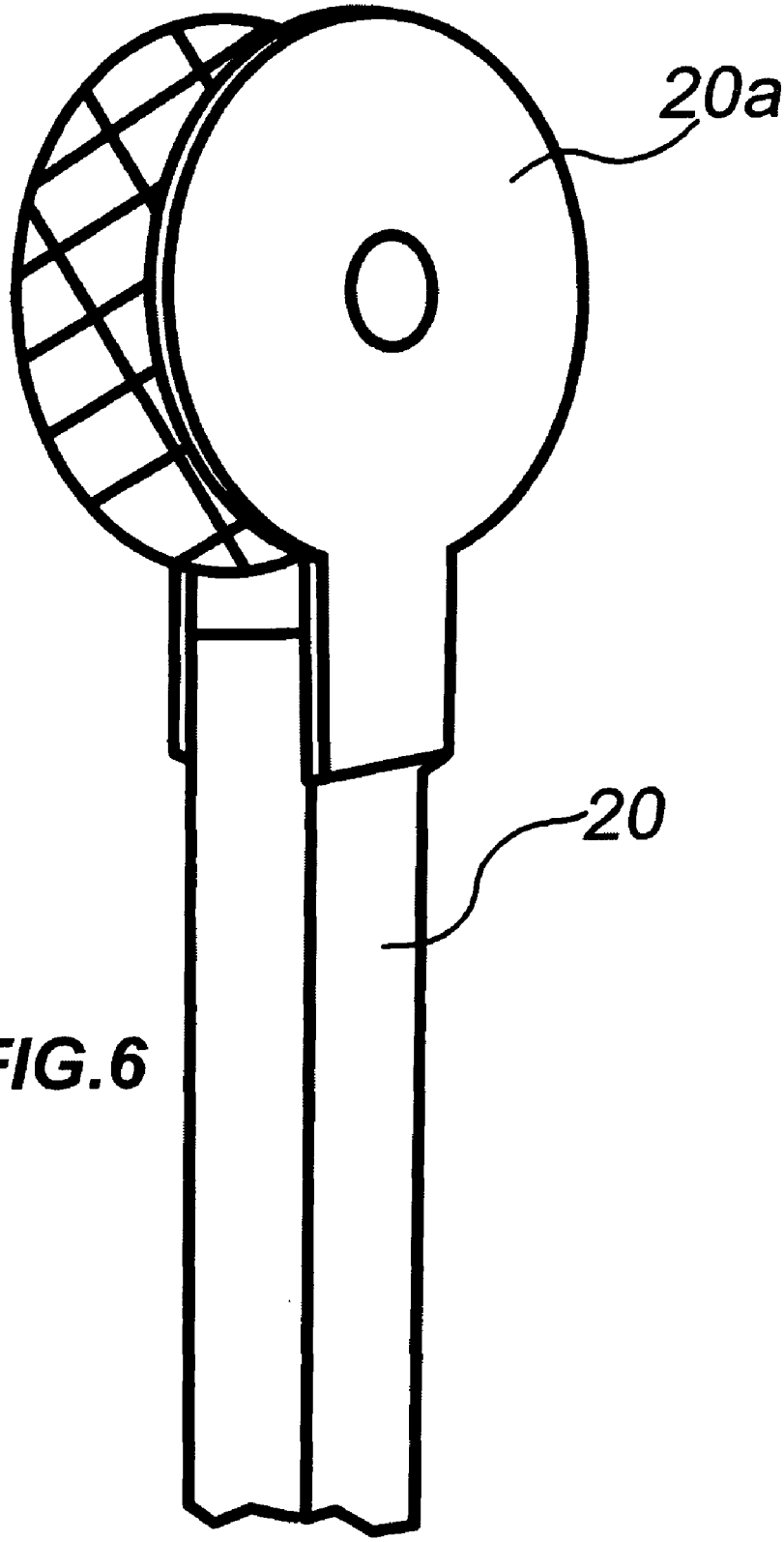
FIG. 6 shows the uppermost portion of the telescoping member with clamp plates.

FIG. 5 shows the pivoting boom 22 and handle 22*a*, the clamp pivot 21, the quick release pin(s) 21*a* for the attachment of the boom extension 19, and the pivot clamp tensioner 21*b* with two compression plates 21*c*. Each compression plate resides on the outer facing side of each circular plate 20*a* which are affixed to the end of the telescoping member 20 and each circular plate has an inner textured surface providing a compression and friction fit against the sides of the pivoting boom holder 21. FIG. 6 shows the uppermost portion of the telescoping member 20 with clamp plates 20*a* that are compressed by the compression plates 21*c*.

Figure 7:
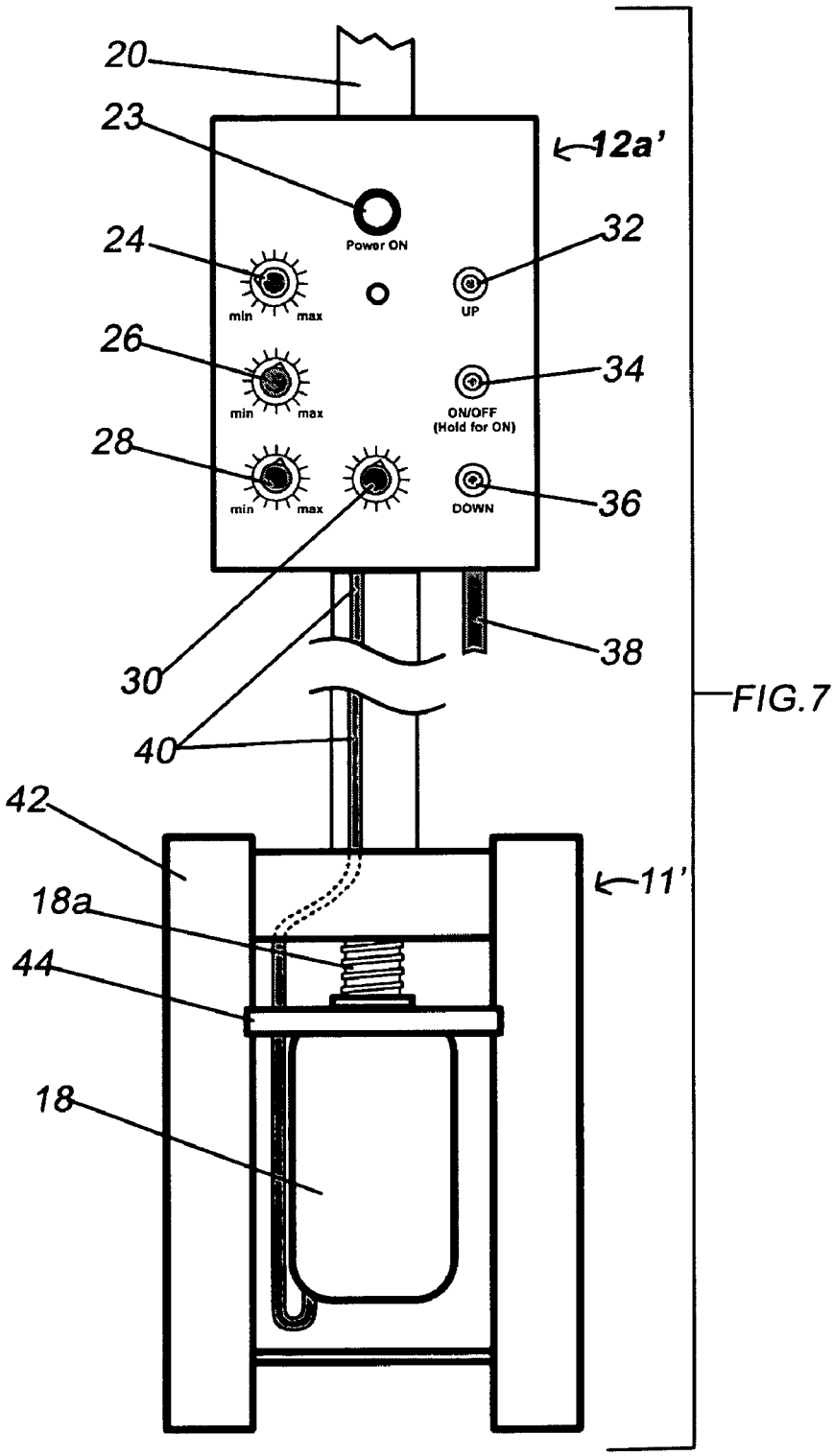
FIG. 7 is a partial plan view of a another embodiment of the controller subassembly.

Referring now to FIG. 7; in another embodiment according to the present invention, the controller is adapted to input a plurality of motive parameters represented by the dials 24, 26, 28, and 30 controlling fast speed setting, slow speed setting, slow to fast time setting and down/up power ratio setting respectively. The vertical movement may be initiated manually by pressing the up/down buttons 32, 36 on the control panel, or pressing one of two buttons on the RF transmitter; the motion attributes however, are set by adjusting the dials on the control panel.

Figure 8:
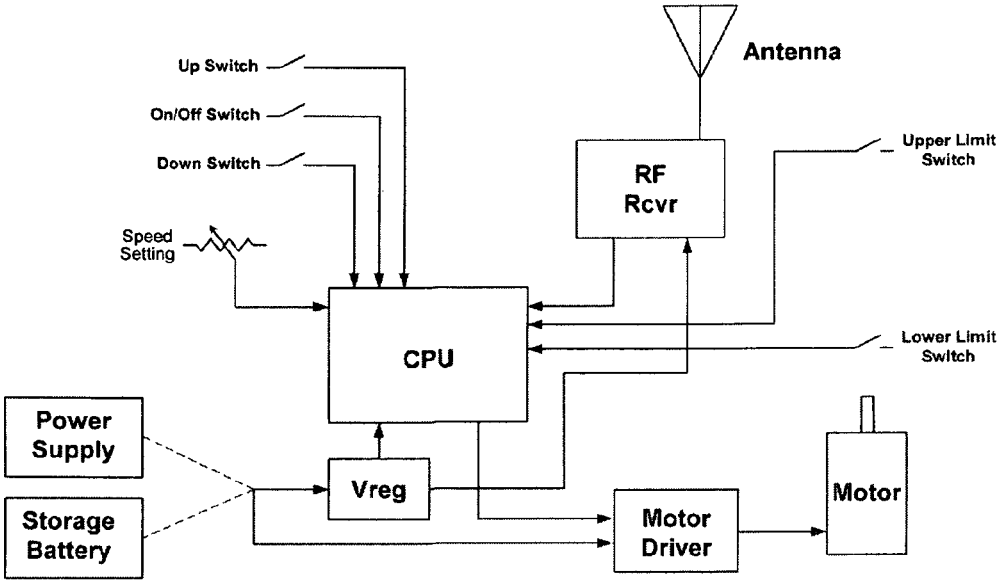
FIG. 8 is a block level diagram of the basic components of the controller according to the preferred embodiment.
Figure 9:
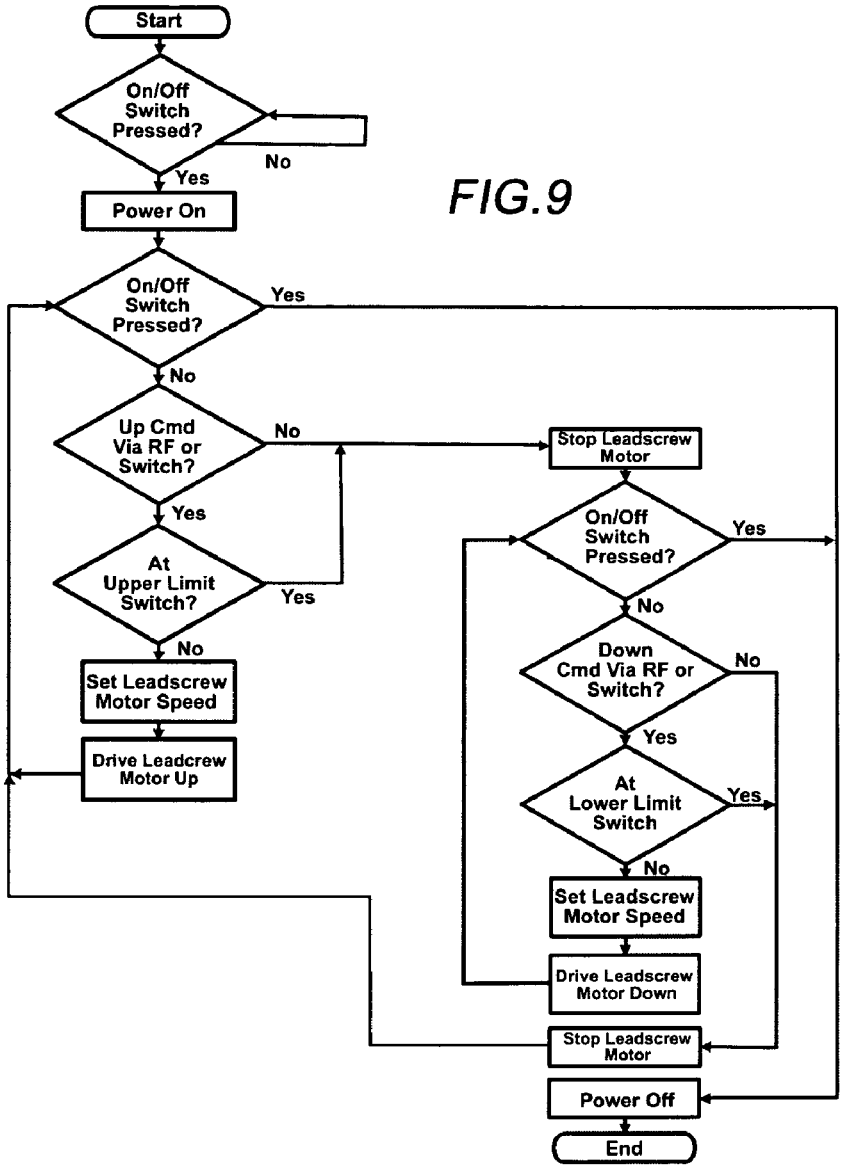
FIG. 9 is an operational flow diagram of the controller logic according to the preferred embodiment.

FIG. 8 is a block diagram of one possible circuit allowing for the pre-selection of motor speed and vertical movement of the telescoping member 20. FIG. 9 represents one possible operational flow of the logic of the controller.

Figure 10:
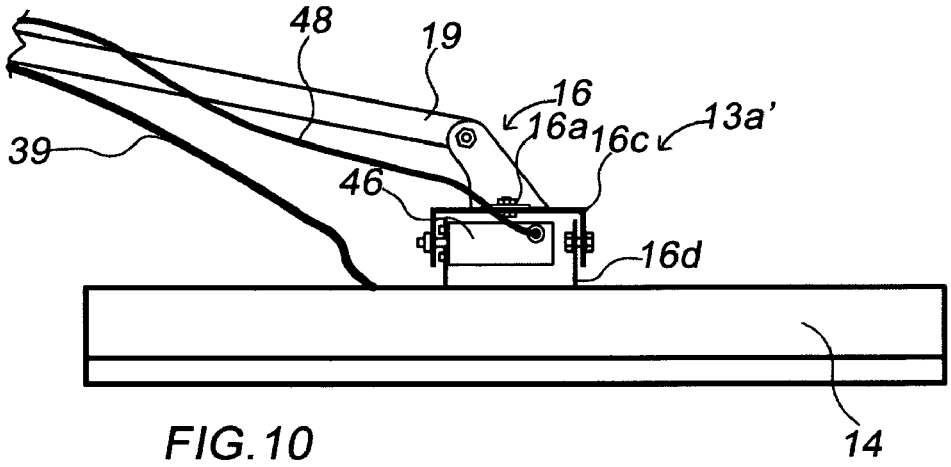
FIG. 10 shows an alternate embodiment with a light housing being tilt-able in either direction relative to its axis.
Figure 11:
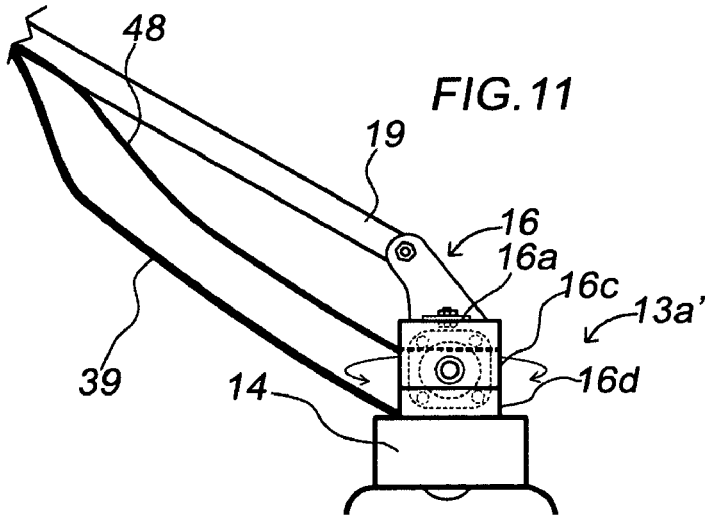
FIG. 11 shows the embodiment of FIG. 10 swiveled to reveal one end of the light housing.
Figure 12:
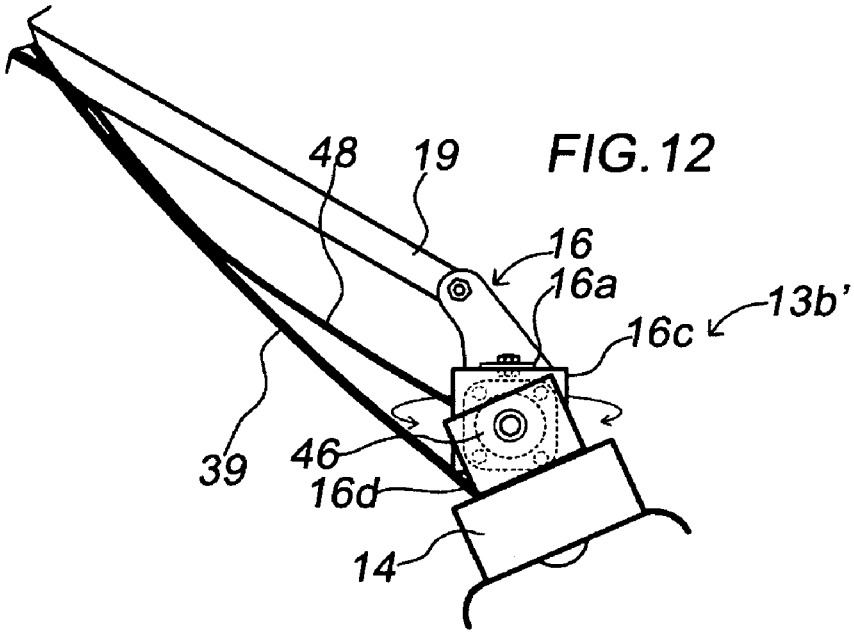
FIG. 12 shows the embodiment of FIG. 10 where the light housing is tilted by the tilt motor.

Referring now to FIGS. 10-12; in another embodiment according to the present invention, a lighting subassembly 13*b'* with a tilting means mounted atop the light housing 14 enabling the light housing to tilt in either direction relative to its axis. The light housing is rotatable about a rotatable coupling 16*a* mounted atop 'U' bracket 16*c*. The mounting plate of a bi-directional motor 46 is mounted to one end of 'U' bracket 16*d* which is joined to one end of 'U' bracket 16*c*. The other end of 'U' bracket 16*c* is affixed to the shaft of motor 46. The 'U' brackets each have aligning apertures that hold the brackets in a pivotable relationship and are moved by motor 46. FIG. 11 shows the light housing 14 rotated about the rotatable coupling 16*a* to reveal an end view of the light housing. FIG. 12 shows the light housing 14 in a tilted position.

Figure 13:
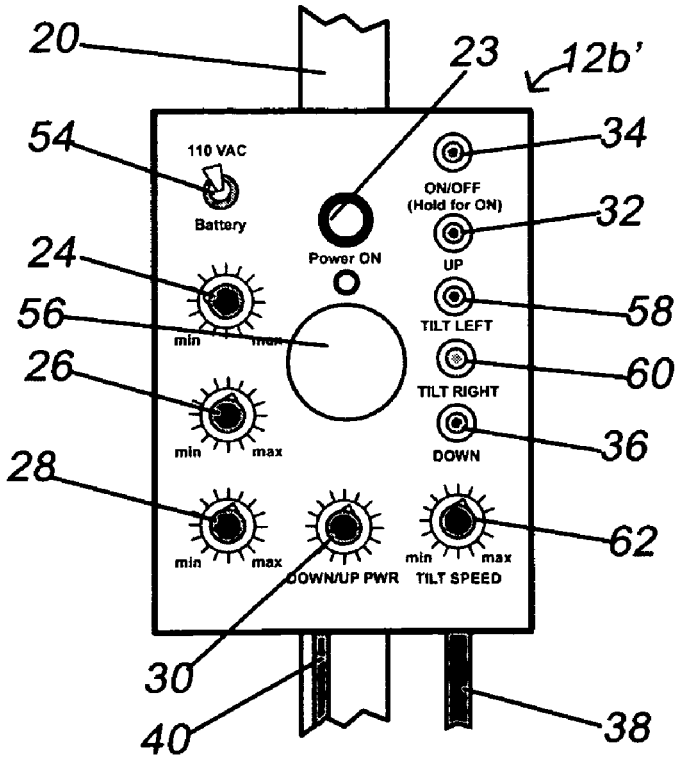
FIG. 13 shows the control panel coinciding with the embodiment shown in FIGS. 10-12.

FIG. 13 shows the control panel of controller subassembly 12*b'* corresponding to the embodiment shown in FIGS. 10-12 having tilt switches 58, 60 controlling the left tilt and right tilt of the light housing respectively and dial 62 that controls the tilt speed setting. The left and right tilt motions are also remotely controllable by a version of the RF key fob having four switches. An AC/DC power toggle 54 toggling between power modes, and an emergency off switch 56 are shown, both of which may be used in combination with the control panel elements of any of the aforementioned embodiments.

A battery platform 52 useable with any of the aforementioned embodiments is mounted on the rolling base as shown in FIG. 14. There are a number of ways to mount the platform; directly mounted to one or more of the legs of the base, mounted by way of a 'U' bracket fitted over one of the legs and various other means that will be readily understood and appreciated by one skilled in the art.

FIG. 15 is a block level diagram of the basic components of the controller according to the embodiment shown in FIGS. 10-13.

FIG. 16 is a typical operational flow diagram of the controller logic according to the embodiment shown in FIGS. 10-13.

The following non-limiting examples are given to illustrate the setting up and operation of the present invention.

EXAMPLE 1

Set Up Procedure

1. Extend the pivoting legs of the base subassembly into working position and secure them into place with threaded knobs or thumbscrews with the wheels contacting the floor and the rigid studs pointed up.
2. Position the light stand subassembly upon the base subassembly inserting the rigid studs into the channel elements on either side of the actuator housing and secure with threaded knobs.
3. Insert the pivoting and rotating boom into the lighting subassembly boom extension.
   a) Secure the lighting subassembly to the pivoting boom using one or more quick release pins.
   b) If the light housing is tilted to either side of the boom extension, the boom extension should be aligned to the pivoting boom such that the housing can have its normal range of motion when the lighting subassembly is in the most common position; with the pivoting boom handle generally angled toward the floor.
4. Connect the system to a power source.
   a) If the system is a 110-120 VAC unit, the controller and light housing are plugged into a standard AC outlet.
   b) If the system runs off of a storage battery, the battery box and battery are mounted on preferably one or more of the shorter legs of the base subassembly. Power wires for the controller and light housing are then connected to the battery.

EXAMPLE 2

Procedure for Operating (Vehicle Surface Repair)

1. Power up the system by pressing and holding the ON/OFF switch on the control panel for a predetermined length of time; normally a few seconds, until the system tones and the power on indicator lights up.
2. Set the motive properties of the assembled system via the dial(s) on the front of the controller, testing the setting(s) by using the manual up and down switches on the controller or the RF key fob and adjusting further if necessary.
3. Move the assembled system to its working position.
   a) If the system uses a fluorescent light source, the light stand is typically positioned on the opposite side of a vehicle from the repair technician with the bulb positioned such that it is above an upper surface of the vehicle and perpendicular to the direction the technician is facing while working.
   b) The pivoting boom is pivoted up or down in order to position the light housing at the lower end of the working distance from the vehicle.
   c) If more range is needed, the light may be moved up or down using the control panel UP or DOWN switches, or remotely via the RF key fob.
   d) If the embodiment has the automated tilt feature, the tilt of the light housing relative to the surface of the vehicle is adjusted via the tilt switches on the control panel or the RF key fob.
4. Begin repairing dents.
   a) Using the remote control, the technician may control the light from his working position so that the light's reflection is directly over one or more dents.
   b) The tech moves on to other dents needing repair by simply repositioning the light up or down using the RF remote control. Moving the light up and down causes the reflection of the light to move back and forth across the surface of the vehicle. The tech can also remotely run the light up and down from their work position to check for dents that may have been missed or for dents that may have not been repaired correctly.
   c) If the embodiment has the automated tilt feature, the technician also has the ability to remotely adjust the tilt angle of the light housing to give optimum lighting of the dents to be repaired via the RF key fob.
   d) The light stand can also be used to repair dents on the sides of a vehicle by positioning the light housing in the vertical position, as is well known to person skilled in the art.

EXAMPLE 3

Disassembly Procedure

1. Lower the telescoping member via the DOWN switch on the control panel or using the RF key fob until it contacts the lower limit switch and the system is at its minimum height.
2. If system has automated tilt feature, the tilt of the light housing relative to the boom extension can be advanced towards either of its extremes, to lessen the overall height of the lighting subassembly, if that makes it easier to transport and/or store.
3. Power off the system by pressing the ON/OFF switch. The system will tone and the power on indicator will go off
4. Disconnect the system from the power source.
   a) If the system is a 110-120 VAC unit, the controller and light housing are unplugged from the AC outlet.
   b) If the system runs off of a storage battery, the power wires for the controller and light housing are disconnected from the battery. The battery box and battery are then removed from the shorter leg or legs of the system by removing the threaded knob(s) or thumbscrew(s) and lifting them off.
5. Remove the lighting subassembly from the pivoting boom by removing one or more quick release pins from the boom extension and sliding them apart.
6. Remove the light stand subassembly from the base subassembly by loosening the threaded knobs at the base of the light stand subassembly and lifting it off.
7. Release and retract the pivoting legs into storage position by removing the threaded knobs or thumbscrews.

I claim:

1. A remotely positionable work-light comprising:
a removable post assembly have a telescoping member within a upright conduit; and,
a movable boom affixed to the telescoping member; and,
a movable light housing affixed to one end of the boom; and,
a radio frequency responsive controller having a circuit and power source; and,
a linear actuator for the vertical movement of the telescoping member and responsive to the controller, and,
a radio frequency transmitter; and,
a rollable and collapsible stand supportive of the post assembly, the linear actuator and the controller; and,
at least one power cord.

2. The remotely positionable work-light according to claim 1 in which the radio frequency transmitter signals the controller to actuate the linear actuator to move the telescoping member up and down in order to raise and lower the light housing as required.

3. The remotely positionable work-light according to claim 1 in which manual switches interfacing with the controller actuate the linear actuator to move the telescoping member up and down in order to raise and lower the light source as required.

4. The remotely positionable work-light according to claim 1 in which the controller has at least one telescoping speed setting.

5. The remotely positionable work-light according to claim 1 in which the controller has a plurality of telescoping speed settings.

6. The remotely positionable work-light according to claim 1 in which a ratio between the power applied to the linear actuator for one direction of extension versus the other direction can be set.

7. The remotely positionable work-light according to claim 1 in which the time before changes in the speed of the linear actuator can be set.

8. The remotely positionable work-light according to claim 1 in which the light source is tillable by means of a variable speed motor driven by the controller.

9. The remotely positionable work-light according to claim 1 in which the linear actuator is an electrically powered jack-screw type.

10. The remotely positionable work-light according to claim 1 in which the power source is 110-120 VAC.

11. The remotely positionable work-light according to claim 1 in which the power source is 12-24 VDC.

12. The remotely positionable work-light according to claim 1 in which the power source is switchable between 110-120 VAC and 12-24 VDC.

* * * * *